United States Patent [19]

Bias

[11] Patent Number: 4,989,877

[45] Date of Patent: Feb. 5, 1991

[54] GOLF PRACTICE DEVICE

[76] Inventor: Thomas W. Bias, Rte. 6, Box 279, South Point, Ohio 45680

[21] Appl. No.: 509,756

[22] Filed: Apr. 17, 1990

[51] Int. Cl.[5] ..... A63B 69/36

[52] U.S. Cl. ..... 273/200 R; 273/DIG. 21

[58] Field of Search ..... 273/200 R, 200 A, 200 B, 273/185 C, 184 B, 198, DIG. 21

[56] References Cited

U.S. PATENT DOCUMENTS 3,051,491 8/1962 Cabot ..... 273/200 R 3,498,613 3/1970 Dreyer ..... 273/200 R 4,927,154 5/1990 Boyer et al. ..... 273/200 R

*Primary Examiner*—George J. Marlo

*Attorney, Agent, or Firm*—Terry Gernstein

[57] ABSTRACT

A golf accessory includes a golf tee-like element attached to a tethering unit which includes a bungee cord and a monofilament line. The tethering unit is attached to a solid center golf ball by a swivel connecting assembly which permits the gold ball to rotate without twisting the tethering unit.

2 Claims, 1 Drawing Sheet

GOLF PRACTICE DEVICE

TECHNICAL FIELD OF THE INVENTION

The present invention relates to the general art of amusement devices, and to the particular field of golf accessories.

BACKGROUND OF THE INVENTION

As every golfer knows, golf skills can always be improved by practice. No matter how proficient the golfer is, practice can improve that golfer's game. For this reason, the art has included a plethora of golf practice accessories.

Practicing golf generally includes striking a golf ball which will travel varying distances. Other than putting, chipping and short iron practice, these distances can be quite great. Since proper and adequate practice generally requires the golfer to hit a great number of golf balls, retrieving such balls can be an onerous task. Accordingly, many golfers use driving ranges or shag caddies for this purpose.

However, since driving ranges or shag caddies are not always available whenever a golfer desires to practice, the art has included several assemblies which include a golf ball that is tethered to an anchor whereby the ball can be retrieved after it has been struck.

While somewhat successful in providing a ready practice assembly, these tethered ball devices and assemblies have certain shortcomings which inhibit their full commercial acceptance. For example, such devices generally attach a tether to a golf ball in a manner that interferes with the natural rotation of that ball during flight. Such interference changes the rotation pattern of the ball from that pattern associated with the stroke and impact of the golfer. Thus, the line of flight for such golf balls may differ from that line of flight associated with an untethered golf ball struck in the identical manner. For this reason, the golfer may not receive a true reading of his swing. The golfer could have a serious flaw in this swing that is not detected because the tethered ball is not permitted to undergo its natural rotation and does not hook or slice. Even worse, the unnatural rotation may cause the golfer to develop a swing habit which causes a ball to hook or slice when it is not tethered but will fly straight and true when it is tethered.

Another drawback to presently available tethered systems is that cumbersome nature thereof in storage. The tethering may tend to twist during use and tangle during storage. Such tangled or twisted tethering may inhibit use of the device.

Accordingly, there is a need for a golf accessory that permits a golfer to accurately see the results of his golf swing by tethering the golf ball to an anchor in a manner such that rotation imparted to the ball by impact of the club is not inhibited or interfered with, and the tethering means is not twisted in use or tangled during storage.

OBJECTS OF THE INVENTION

It is a main object of the present invention is to provide a golf accessory that permits a golfer to accurately see the results of his golf swing.

It is another object of the present invention to provide a golf accessory that permits a golfer to accurately see the results of his golf swing by tethering the golf ball to an anchor in a manner such that rotation imparted to the ball by impact of the club is not inhibited or interfered with.

It is another object of the present invention to provide a golf accessory that permits a golfer to accurately see the results of his golf swing by tethering the golf ball to an anchor in a manner such that rotation imparted to the ball by impact of the club is not inhibited or interfered with, and the tethering means is not twisted in use or tangled during storage.

SUMMARY OF THE INVENTION

These, and other, objects are achieved by a golf accessory that includes an anchor to which a Wolf ball is attached by a tethering unit that permits the ball to spin without twisting a tethering cord. The tethering unit includes a bungee cord, monofilament line, an elastic cord and a swivel connection.

In this manner, the golf ball can undergo that rotation which is associated with the particular golf swing used to strike the ball and will not twist the tethering cord during flight. Prevention of tethering cord twist prevents the tethering means from influencing the flight of the ball and helps to prevent tangling of that tethering cord during use or during storage.

BRIEF DESCRIPTION OF THE DRAWING FIGURES

DETAILED DESCRIPTION OF THE PREFERRED EMBODIMENT OF THE INVENTION

Figure 1:
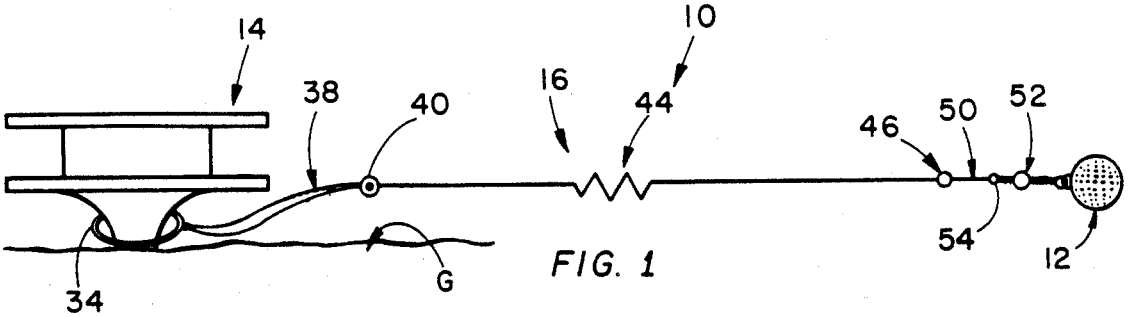
FIG. 1 is a side elevational view of the overall system of the present invention.

Shown in FIG. 1 is a system 10 in which a golf ball element 12 is attached to an anchor unit 14 by a tethering unit 16 which permits that golf ball to spin without twisting the tethering means of the tethering unit.

Figure 2:
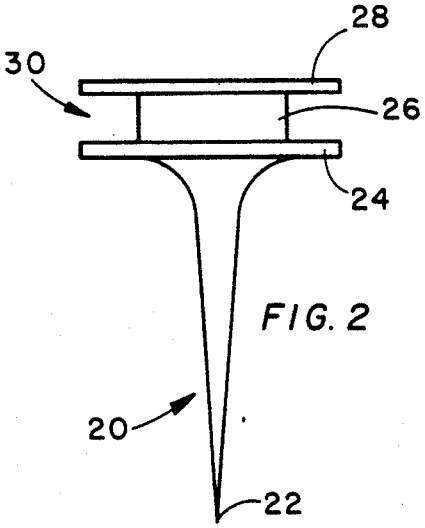
FIG. 2 is an elevational view of an anchoring device used in the system of the present invention.

The anchor unit is best shown in FIG. 2 to include a tee-like element 20 having a point 22 on one end thereof to lead and guide the element 20 into the ground G in the manner of a golf tee. The element 20 is tapered towards that point to facilitate entry thereof into the ground. A first flange 24 is mounted on the element 20 to be located remote from the point 22 and to extend parallel to the ground when the anchor is embedded therein.

A cylindrical spool body 26 is affixed at one end thereof to the first flange 24 and extends upwardly therefrom when the anchor is in the use configuration. A second flange 28 is affixed to the spool at a location remote from the first flange 24 and is parallel to and spaced from the first flange. The spool body and the flanges thus define a spool unit 30, the purpose of which will be evident from the ensuing discussion. The anchor element 20 is preferably formed of turned wood or injection-molded plastic.

Figure 3:
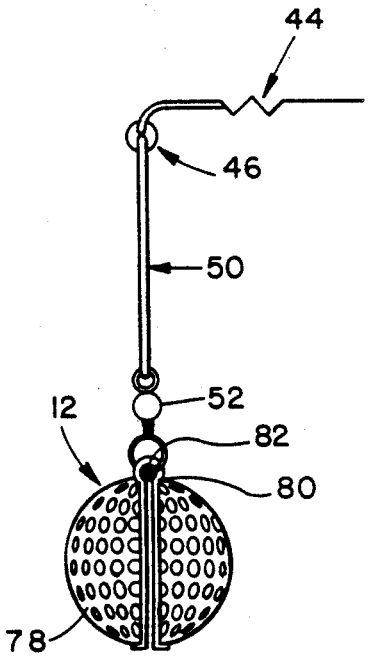
FIG. 3 is an elevational view of a golf ball and a swivel connecting assembly of the present invention.

As shown in FIGS. 1 and 3, the tethering unit 16 includes a ring 34 that encircles the anchor body 20 and is positioned subadjacent to the first flange 24 when the assembly is in use. A bungee cord 38 is attached at one end thereof to the ring 34 and has a second ring 40 on the other end thereof. The bungee cord absorbs shock associated with the golf ball reaching the end of the tethering unit and still having some forward momentum, and is preferably formed of molded rubber or woven and encased strands of elasticized thread.

A length of monofilament line 44 is attached at one end thereof to the second ring 40, and preferably is a twenty-five pound test line.

A grommet 46 is attached to the line 44 at a second end of that line, and is preferably made of rubber or plastic.

An elastic cord 50 is attached at one end thereof to the grommet and is made of an elastomer or an elasticized thread and serves as an absorber of kinetic energy. The cord 50 is lighter in weight and mass than the bungee 38 so as not to inhibit the flight and rotation of the golf ball during flight. If the tether reaches the end thereof while the golf ball still has forward momentum, such forward momentum is Partially absorbed by the cord 50.

A swivel connecting assembly 52 is attached at one end thereof to a second end of the cord 50 and connects that cord 50 to the golf ball element 12 in a manner that prevents rotation of the ball from twisting the cord 50.

Figure 4:
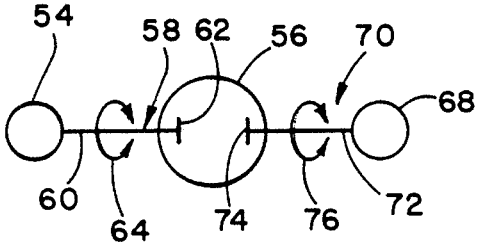
FIG. 4 is an elevational view of a swivel unit used in the swivel connecting assembly.

The assembly 52 is best shown in FIGS. 1 and 4 and includes a cord connecting ring 54 connected to the cord 50 and a body 56 connected to the cord connecting ring by a first swivel joint 58. The joint 58 includes a rod 60 attached at one end thereof to the ring 54 and extending into the body 56 and having a flange 62 on the end thereof that is located inside the body 56. The rod will rotate about its axis in the directions indicated by the double-headed arrow 64 so that the ring 54 can rotate with respect to the body 56.

The assembly 52 further includes a second connecting ring 68 connected to the body 56 by a joint 70 having a rod 72 attached at one end thereof to the ring 68 and extending into the body 56 and having a flange 74 on the end thereof located inside the body 56. The rod 72 moves in the directions indicated by the double-headed arrow 76 to further enhance the swiveling feature of the assembly.

The golf ball element 12 is best shown in FIGS. 1 and 3, and includes a golf ball 78 that is a solid core type golf ball. A steel cotter pin 80 is inserted into the golf ball 78 and is affixedly attached thereto. A cotter ring 82 attaches the cotter pin 80 to the second connecting ring 68 to affix the golf ball element to the swivel connecting assembly. Suitable means, such as epoxy or the like, is used to affix the cotter pin 80 to the golf ball 78.

Figure 5:
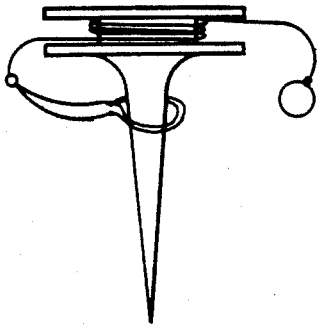
FIG. 5 is an elevational view of the system in a stored configuration.

The tethering unit is stored by winding it about the spool assembly 30 as shown in FIG. 5 whereby the cords and lines will not become twisted during storage Since the rotation of the golf ball in flight is not transmitted to the cords and lines of the tethering unit, that unit is not likely to become twisted during use, so tangling from this cause is not likely. Still further, since the ball is free to rotate without influence of the tethering unit cords and lines, the rotation of that ball tending to cause hooks or slices will be retained so the golfer can correct his swing.

It is understood that while certain forms of the present invention have been illustrated and described herein, it is not to be limited to the specific forms or arrangements of parts described and shown.

I claim:

1. A golf accessory comprising:

(A) an anchor which includes a golf tee-like element having (1) a body having a point on one end for guiding said anchor into a supporting medium, such as the ground, (2) a first flange mounted on a second end of said body remote from said first end, (3) a cylindrical spool body attached at one end thereof to said first flange and extending parallel to the ground when said body is embedded in the ground in an operative orientation, (4) a second flange mounted on a second end of said spool body and being oriented to be parallel to said first flange and spaced from said first flange,;

(B) a tethering unit connected to said anchor unit and including (1) a ring element on said tee-like element body, (2) a bungee cord attached at one end thereof to said ring element, and having a second ring element attached thereto at a second end thereof, (3) a monofilament line connected at one end thereof to said second ring element, (4) a grommet affixed to a second end of said monofilament line, (5) an elastic cord attached at one end thereof to said grommet, and (6) a swivel connecting assembly attached at one end thereof to a second end of said elastic cord and having (a) a cord connecting ring on said swivel connecting assembly one end, (b) a body connected to said cord connecting ring,.

(c) a first swivel joint connecting said body to said cord connecting ring, (d) a second connecting ring connected to said body, and (e) a second swivel joint connecting said body to said second connecting ring; and (D) a golf ball element which includes (1) a solid core golf ball having a diameter, (2) a cotter pin securely affixed to said golf ball to extend along said golf ball diameter and having a cotter ring on one end thereof, said swivel connecting assembly second swivel joint being connected to said cotter ring, and (3) fixing means fixedly securing said cotter pin to said golf ball.

2. The accessory defined in claim 1 wherein said fixing means includes epoxy adhesive.

* * * * *